US006935317B2

(12) United States Patent
Wiesenberger et al.

(10) Patent No.: US 6,935,317 B2
(45) Date of Patent: Aug. 30, 2005

(54) FUEL SUPPLY AND DIAGNOSTICS MODULE

(75) Inventors: Juergen Wiesenberger, Clarkston, MI (US); Richard Hurley, Rochester Hills, MI (US)

(73) Assignee: Siemens VDO Automotive Corporation, Auburn Hills ( * ) Notice: Subject to any disclaimer, the term of this patent is extended or adjusted under 35 U.S.C. 154(b) by 65 days.

(21) Appl. No.: 10/725,866

(22) Filed: Dec. 2, 2003

(65) Prior Publication Data

US 2004/0149271 A1 Aug. 5, 2004

Related U.S. Application Data

(60) Provisional application No. 60/444,051, filed on Jan. 31, 2003.

(51) Int. Cl.[7] ..... F02M 33/04
(52) U.S. Cl. ..... 123/519; 701/114
(58) Field of Search ..... 123/516, 518–520, 123/406.45–406.48, 480; 701/103–105, 114–115

(56) References Cited

U.S. PATENT DOCUMENTS 5,038,741 A * 8/1991 Tuckey ..... 123/509
5,454,697 A * 10/1995 Nakanishi ..... 417/423.3
5,457,633 A * 10/1995 Palmer et al. ..... 701/112
5,754,968 A * 5/1998 Hedstrom ..... 701/66
6,435,164 B1 * 8/2002 Kaiser et al. ..... 123/516
2002/0083702 A1 * 7/2002 Iihoshi et al. ..... 60/285
2002/0174857 A1 * 11/2002 Reddy et al. ..... 123/520
2003/0221675 A1 * 12/2003 Washeleski et al. ..... 123/497
2004/0031469 A1 * 2/2004 Reddy ..... 123/519
2004/0084018 A1 * 5/2004 Zhu et al. ..... 123/406.14

* cited by examiner

*Primary Examiner*—Thomas Moulis

(57) ABSTRACT

A fuel supply system includes one fuel supply and diagnostic module that is used to control various fuel supply system components. The fuel supply and diagnostics module includes a fuel system control unit that operates separately from an engine control unit. The engine control unit and fuel system control unit are electrically connected together via a two-wire connection. The fuel supply and diagnostics module includes a fuel pump with controls and diagnostics generated by the fuel system control unit. The fuel supply and diagnostics module also includes a fuel level sensor and leak detection apparatus that also have controls and diagnostic generated by the fuel system control unit. The fuel supply and diagnostics module is easily installed into a fuel tank as a single unit.

15 Claims, 3 Drawing Sheets

FUEL SUPPLY AND DIAGNOSTICS MODULE

BACKGROUND OF THE INVENTION

The application claims priority to U.S. Provisional Application No. 60/444,051, which was filed on Jan. 31, 2003.

A fuel supply system includes a fuel pump assembly that pumps fuel from a fuel tank into a vehicle engine based on commands from an engine control unit. The fuel supply system also includes a fuel level sensor that measures and monitors the amount of fuel remaining in the tank. A leak detection assembly determines whether there are fuel leaks within the fuel supply system. The fuel pump assembly, fuel level sensor, and leak detection assembly each require a diagnostic function to indicate whether or not each of the respective components is operating effectively.

Traditionally, each of these fuel supply system components have either had separate control units or have been controlled by the engine control unit. When the fuel pump assembly, fuel level sensor, and leak detection assembly include separate control units, each of the control units must be connected to the engine control unit. This creates a significant number of connections to the engine control unit and requires additional wiring. This increases system cost and assembly time while potentially decreasing system reliability due to the high number of connections.

There are also disadvantages to controlling the fuel pump assembly, fuel level sensor, and leak detection assembly with the engine control unit. This configuration requires the engine control unit to have a significant amount of processing power. Further, the engine control unit must remain active when the vehicle is shut off so that the leak detection assembly can determine whether there are any fuel system leaks. Typically, it takes four to six hours to cool a fuel tank down to a temperature where leaks can accurately be detected. Requiring the engine control unit to remain active over this period of time can significantly drain power from the vehicle.

Thus, there is a need for a fuel supply and diagnostic module that operates separately from the engine control unit, but which reduces the overall number of connections to the engine control unit in addition to overcoming the other above-mentioned deficiencies in the prior art.

SUMMARY OF THE INVENTION

A fuel supply and diagnostics module includes one fuel system control unit that has control and diagnostic capability for a fuel pump assembly, a fuel level sensor assembly, and a leak detection assembly. The fuel system control unit operates separately from and communicates with an engine control unit.

In one disclosed embodiment, the fuel system control unit and the engine control unit are electrically connected by a 2-wire connection. No other connections are required. The communication protocol preferably comprises a controlled area network. This configuration allows a more compact engine control unit with reduced processing power to be used. Further, much of the wiring is eliminated and the connections to the engine control unit are significantly reduced.

In one disclosed embodiment, the fuel pump assembly, fuel level sensor, and fuel system control unit are assembled together as a sub-module. The sub-module is installed on the fuel tank as a single unit. The fuel pump and fuel level sensor are positioned inside of the fuel tank, and the fuel system control unit is positioned outside of the fuel tank.

Components from the leak detection assembly are preferably separately mounted on the vehicle. A single wire connection connects the leak detection assembly to the fuel system control unit. The fuel system control unit remains active after the vehicle has been shut off to detect leaks, which allows the engine control unit to be placed in an inactive mode when the vehicle is shut off. This configuration reduces power drain from the vehicle.

The subject invention provides fuel supply and diagnostic module that is easily installed within existing fuel supply systems. The module eliminates much of the wiring previously required and significantly reduces the number of connections to the engine control unit. These and other features of the present invention can be best understood from the following specification and drawings, the following of which is a brief description.

DETAILED DESCRIPTION OF THE PREFERRED EMBODIMENT

Figure 1:
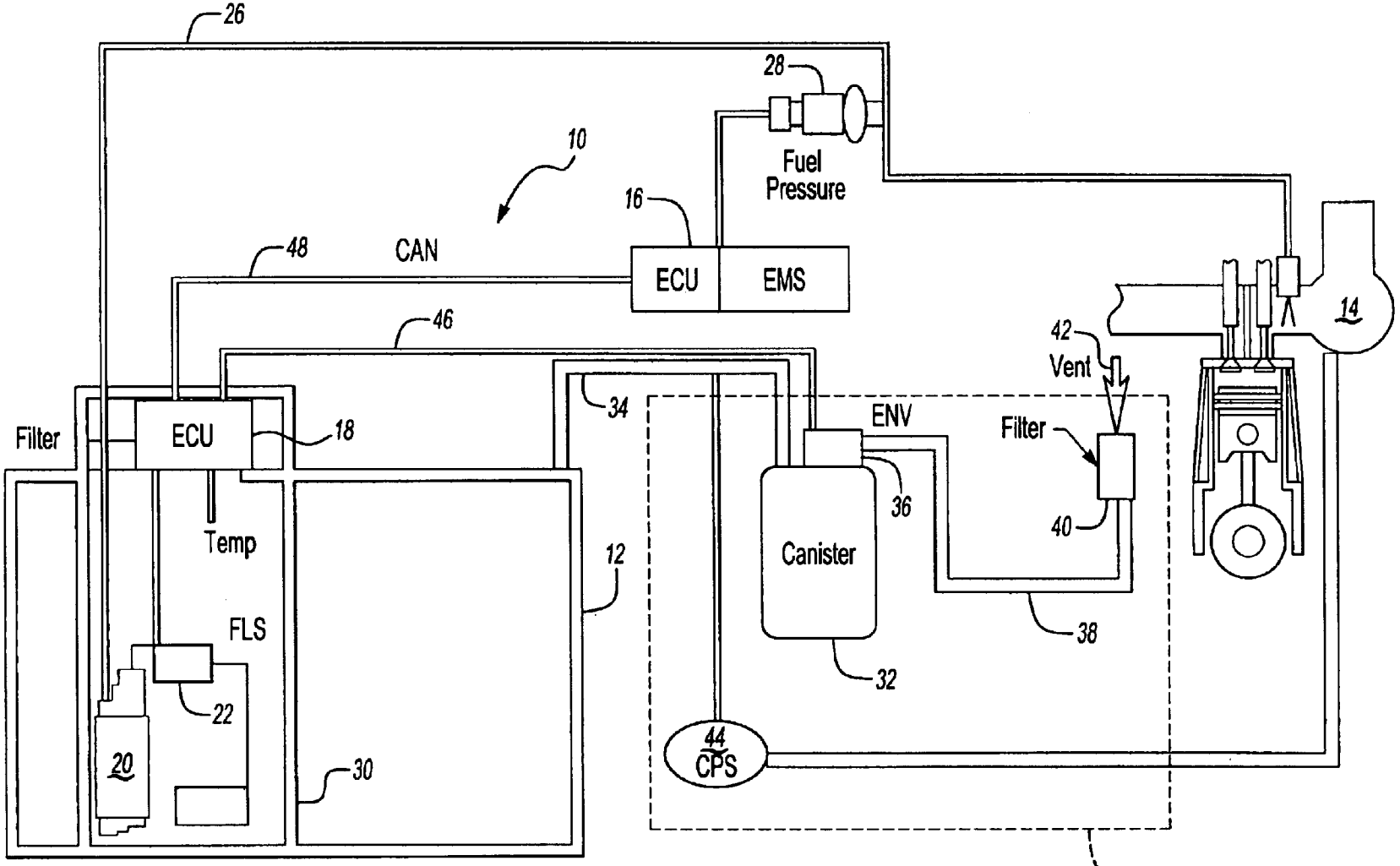
FIG. 1 is a schematic view of a fuel supply system for a vehicle engine incorporating the subject invention.

A fuel supply system is shown generally at 10 in FIG. 1. The fuel supply system 10 provides for the transfer of fuel from a fuel tank 12 to a vehicle engine 14. The vehicle engine 14 is controlled by an engine management system (EMS) that includes an engine control unit 16. The fuel supply system 10 includes a separate fuel supply electronic control unit 18 that includes the controls and diagnostics for the fuel supply sub-systems. The fuel supply sub-systems and fuel supply controller 18 together form a fuel supply and diagnostic module.

Theses sub-systems include a fuel pump assembly 20, a fuel level sensor 22, and a leak detection assembly 24. The fuel pump assembly 20 includes a line connection 26 through which fuel is supplied to the vehicle engine 14. A fuel pressure sensor 28 monitors the fluid pressure in this line connection 26 and communicates with the engine control unit 16. Optionally, the fuel pressure sensor 28 could be configured to communicate directly with the fuel supply control unit 18.

The fuel pump assembly 20, fuel level sensor 22, and the fuel supply control unit 18 are preferably assembled together as a sub-module 30 prior to installation on the vehicle. The sub-module 30 is then installed into the fuel tank 12 as a single unit. The fuel pump assembly 20 and fuel level sensor 22 are positioned inside of the fuel tank 12 and the fuel supply control unit 18 is positioned externally on the fuel tank 12.

The leak detection assembly 24 includes components that are separately mounted on the vehicle from the sub-module 30. In one disclosed embodiment, the leak detection assembly comprises leak detection by natural vacuum. The operation of a leak detection system by natural vacuum is known in the art and will not be discussed in detail. While leak detection by natural vacuum is described as one example of a leak detection assembly 24, it should be understood that any leak detection assembly known in the art could be utilized in the subject fuel supply system. Further, any type of fuel pump assembly 20 or fuel level sensor 22 known in the art could be utilized in the subject fuel supply system 10.

In the example disclosed embodiment, the leak detection by natural vacuum system includes a canister 32 that includes a connection 34 to the fuel tank 12. A vacuum switch 36 is mounted to the canister 32 and includes a connection 38 to a filter 40 and vent 42. A canister purge solenoid (CPS) 44 is positioned between the connection 34 and the vehicle engine 14. A single wire connection 46 electrically connects the vacuum switch 36 to the fuel supply control unit 18. The fuel supply control unit 18 generates control signals and diagnostics requests to the leak detection assembly 24 as required.

The fuel supply control unit 18 comprises a single controller that provides controls and diagnostics for each of the fuel sub-systems. The fuel supply control unit 18 communicates with the engine control unit 16 as needed. The fuel supply 18 and engine 16 control units are electrically connected with a two-wire connection 48. Due to this unique configuration, no other connections are needed. Preferably, a controlled area network (CAN) communication protocol is used for communicating between the fuel supply 18 and engine 16 control units.

The fuel supply control unit 18 includes controls and diagnostics of the fuel pump assembly 20 based on requests from the engine control unit 16. Optionally, the fuel supply control unit 18 can independently control and diagnose the fuel pump assembly 20. The fuel supply control unit 18 also reads and performs diagnostics on the fuel level sensor assembly 22. The fuel supply control unit 18 supplies fuel level sensor and diagnostic information to the engine control unit 16 as needed. The fuel supply control unit also performs the diagnostics for the leak detection assembly 24 and controls the diagnostic hardware.

As previously discussed, each of these control operations were traditionally performed by separate or individual control units, or were performed by the engine control unit. The subject invention combines the fuel system control and diagnostics into a single control module that is separate from the engine control unit. This eliminates additional wiring and connections to the engine control unit. Thus, the engine control unit requires fewer input/output connections and less processing power. Further, the leak detection assembly can be powered after the vehicle is shut off with a low current draw.

Other benefits include decreased system cost and assembly time. The sub-module 30, which includes the fuel pump assembly 20, fuel supply control unit 18, and the fuel level sensor 22, is easily installed within the fuel tank 12 as a single unit. This reduces assembly time, reduces connections, and reduces weight. Further, system reliability is improved because the overall number of connections between the components and the control units is significantly reduced.

Figure 2:
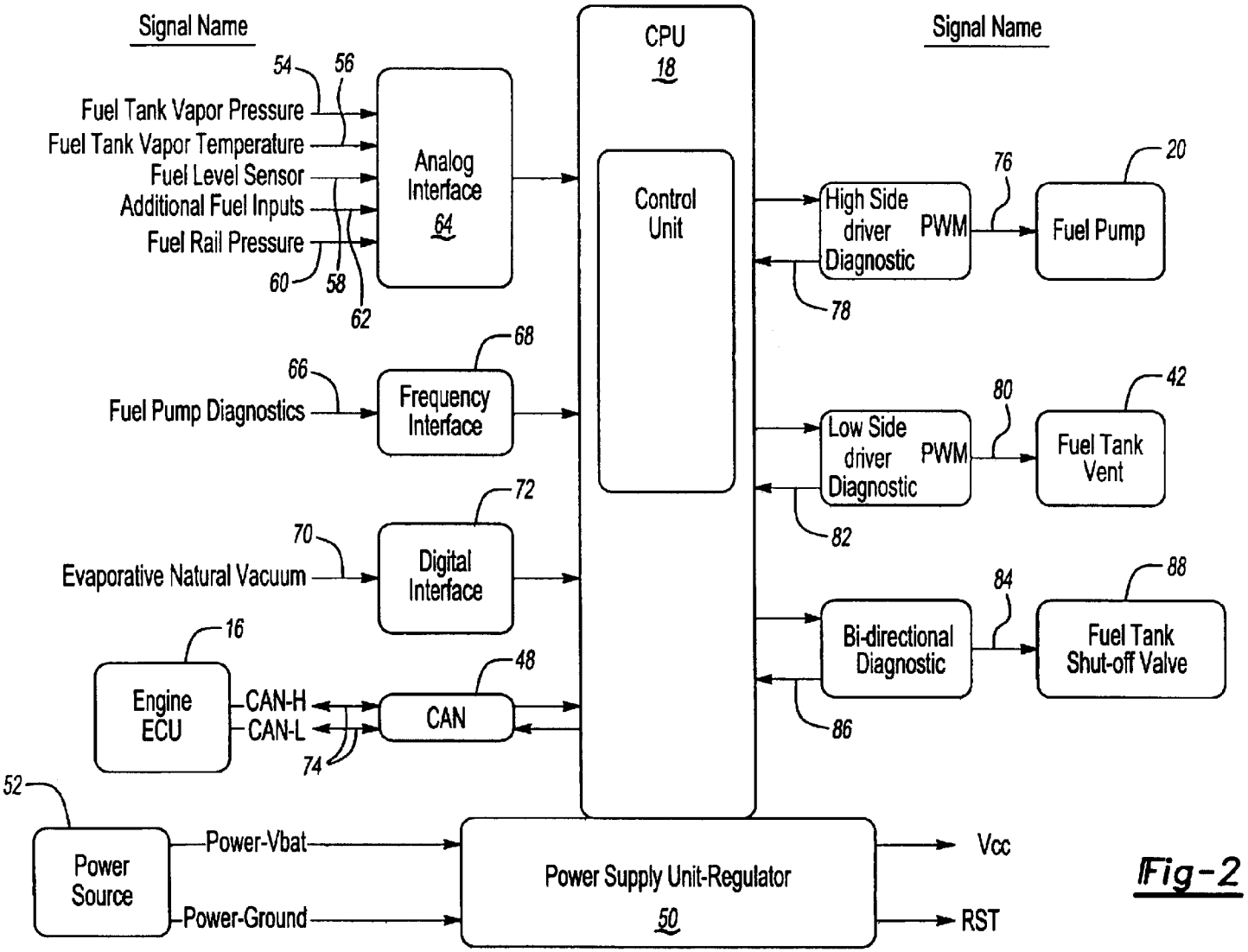
FIG. 2 is a schematic diagram of inputs and outputs from a fuel supply control unit as used in the system of FIG. 1.

One example of a fuel supply control unit 18 is schematically shown in FIG. 2. The fuel supply control unit 18 includes a power supply unit 50 that can easily be connected to a power source 52, such as a vehicle battery. The fuel supply control unit 18 includes various input signals from the fuel pump assembly 20, fuel level sensor 22, and leak detection assembly 24 sub-systems. These input signals can include fuel tank vapor pressure 54, fuel tank vapor temperature 56, fuel level 58, fuel rail pressure 60, and any other additional fuel inputs 62. These inputs 54, 56, 58, 60, 62 are preferably communicated to the control unit 18 through an analog interface 64.

Fuel pump diagnostic signals 66 are preferably communicated to the control unit 18 through a frequency interface 68, while the evaporative natural vacuum leak signals 70 are preferably communicated to the control unit 18 through a digital interface 72. Other input signals include input 74 from the engine control unit 16 through the CAN connection 48, and various diagnostic signals from the fuel sub-systems, which will be discussed below.

The fuel supply control unit 18 also generates a plurality of output control signals. The control unit 18 generates a control signal 76 for operating the fuel pump assembly. A diagnostic fuel pump control signal 78 is also communicated back to the control unit 18 as an input. A fuel tank vent control signal 80 is generated for the fuel tank vent 42 along with a diagnostic fuel tank vent signal 82 that is communicated back as an input. The fuel supply control unit 18 can also generate an output signal 84 and a corresponding diagnostic signal 86 for other sub-systems, such as a fuel tank shut-off valve 88, for example.

While FIG. 2 illustrates a preferred embodiment of the fuel supply control unit 18 input/output configurations, it should be understood that this configuration is simply one example of a working configuration. Other configurations could also benefit from the subject invention.

Figure 3:
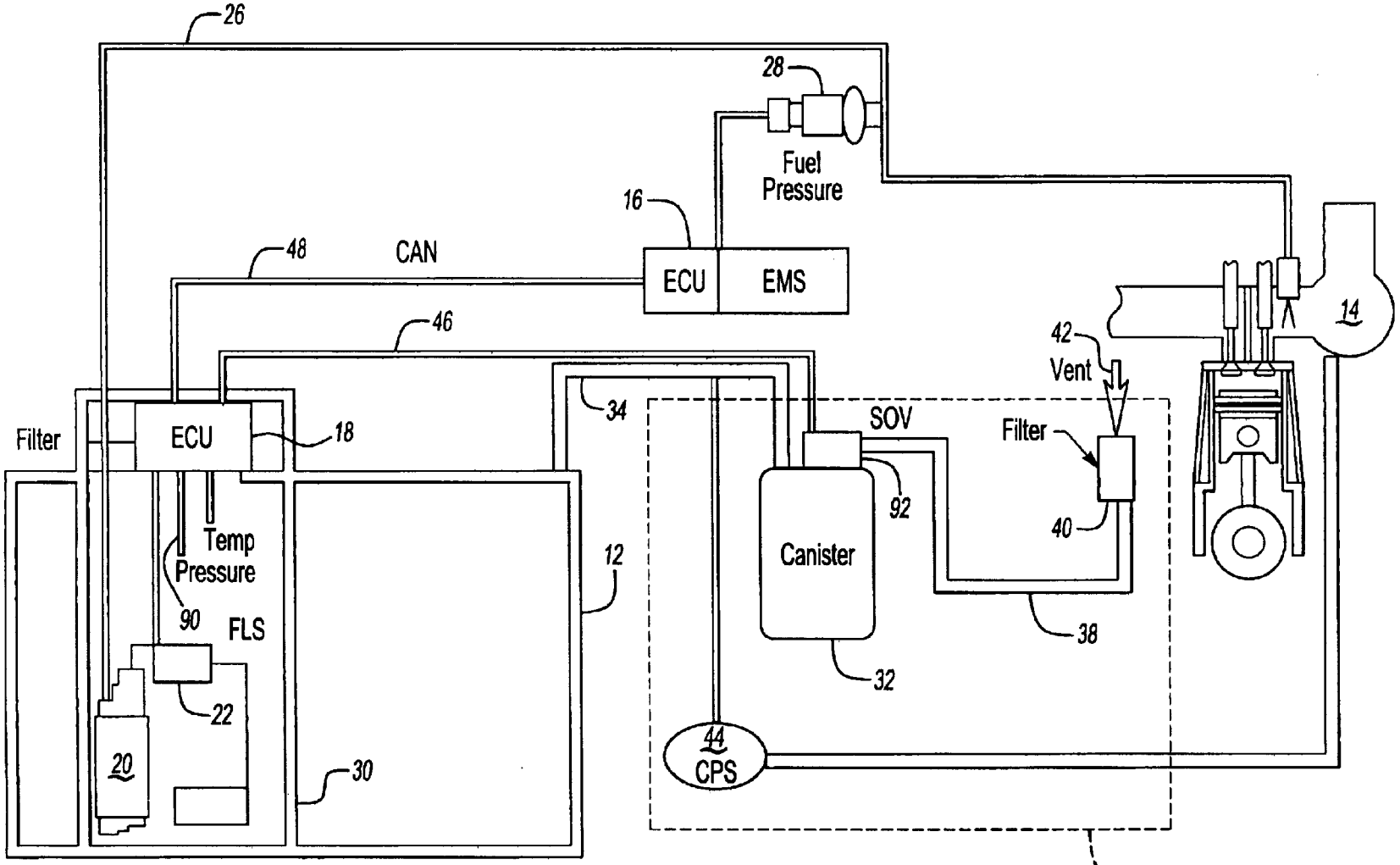
FIG. 3 is a schematic diagram of a variation of the system of FIG. 1.

FIG. 3 shows a variation of the system of FIG. 1. The system is similar to that of FIG. 1 except that fuel pressure 90 is directly communicated to the fuel supply control unit 18 and instead of a vacuum switch 36, a shut off valve (SOV) 92 is incorporated into the leak detection assembly 24. The system operates in a manner similar to the system shown in FIG. 1 and the fuel supply control unit 18 can be configured to the input/output configuration shown in FIG. 2.

As discussed above, the fuel supply control unit 18 is capable of running the leak detection assembly 24 after the vehicle has been shut off with minimal power drain from the vehicle. Typically, it takes four to six hours to cool a fuel tank 12 down to a temperature where leaks can accurately be detected. During this time period, the engine control unit 16 can be shut off or placed in an inactive mode. The fuel system control unit 18 is capable of performing the tests and diagnosis as needed. Further, the control unit 18 is capable of performing the various input/output diagnostics, basic electrical checks, and system communication.

The subject invention provides fuel supply and diagnostic module that is easily installed within existing fuel supply systems. The module eliminates much of the wiring previously required and significantly reduces the number of connections to the engine control unit. Further, system reliability is improved due to the reduction in the number of electrical connections. Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A fuel supply and diagnostic module comprising:

a fuel system including a fuel pump assembly in fluid communication with a fuel tank to supply fuel to a vehicle engine, a fuel level sensor assembly for measuring fuel levels within the fuel tank, and a leak detection assembly for detecting fuel system leaks; and a fuel system control unit that includes controls and diagnostics for said fuel pump assembly, said fuel level sensor assembly, and said leak detection assembly wherein said fuel system control unit cooperates with an engine control unit to provide fuel to a vehicle engine.

2. The module of claim 1 wherein said fuel system control unit is separate from the engine control unit.

3. The module of claim 2 wherein said fuel system control unit is electrically connected to the engine control unit with only a two-wire connection.

4. The module of claim 3 wherein said 2-wire connection includes a communication protocol comprising a controlled area network.

5. The module of claim 1 wherein said fuel pump assembly, said fuel level sensor assembly, and said fuel system control unit are assembled as a sub-module with said sub-module being installed at least partially within said fuel tank.

6. The module of claim 5 wherein said leak detection assembly includes at least one detection component mounted separately from said sub-module and wherein said detection component includes a single wire connection to said fuel system control unit.

7. The module of claim 1 wherein said fuel system control unit generates a fuel pump control signal for controlling operation of said fuel pump assembly, a fuel pump diagnostics signal, a fuel level sensor signal corresponding to a current fuel level, a fuel level sensor diagnostics signal, a leak detection hardware control signal for controlling operation of said leak detection assembly, and a leak detection diagnostics signal wherein said fuel pump diagnostics signal, said fuel level sensor diagnostics signal, and said leak detection diagnostics signal are communicated to the engine control unit.

8. The module of claim 1 wherein said leak detection assembly comprises an evaporative natural vacuum system.

9. The module of claim 1 wherein said fuel system control unit remains active after the engine is turned off to operate said leak detection assembly while the engine control unit remains inactive after the engine is turned off.

10. The module of claim 1 wherein said fuel system control unit includes a power supply unit operably connected to a vehicle battery.

11. A method for supplying fuel and generating fuel system diagnostics for a vehicle engine comprising the steps of:

(a) generating engine control signals from an engine control unit;

(b) generating a fuel pump diagnostics signal and a fuel pump control signal to provide fuel to a vehicle engine;

(c) generating a fuel level sensor diagnostics signal and a fuel level sensor signal corresponding to a current fuel level;

(d) generating a leak detection diagnostics signal and a leak detection hardware control signal for controlling operation of a leak detection assembly; and (e) generating the signals of steps (b) through (d) from a common fuel system control unit that operates independently from the engine control unit.

12. The method of claim 11 including the step of connecting the fuel system control unit to the engine control unit with a 2-wire connection.

13. The method of claim 12 including the step of providing a controlled area network communication protocol via the 2-wire connection.

14. The method of claim 11 including the steps of assembling a fuel pump, a fuel level sensor, and the fuel system control unit to form a sub-module and installing the sub-module at least partially with a fuel tank.

15. The method of claim 11 including the steps of maintaining the fuel system control unit in an active mode after the vehicle is shut off to detect fuel system leaks and deactivating the engine control unit when the vehicle is shut off.

* * * * *